US005251407A

United States Patent [19]

Afshar

[11] Patent Number: 5,251,407

[45] Date of Patent: Oct. 12, 1993

[54] GRINDING DEVICE

[75] Inventor: Mohammad Afshar, Dublin, Ireland

[73] Assignee: Mayka Research and Development, Dublin, Ireland

[21] Appl. No.: 834,396

[22] Filed: Feb. 12, 1992

[30] Foreign Application Priority Data

Feb. 15, 1991 [IE] Ireland ..... 527/91

[51] Int. Cl.[5] ..... B24B 3/36

[52] U.S. Cl. ..... 51/241 R; 51/170 PT; 51/173

[58] Field of Search ..... 51/241 R, 246, 247, 51/241 G, DIG. 15, 170 PT, 173

[56] References Cited

U.S. PATENT DOCUMENTS 1,378,851 5/1921 Fuller ..... 51/241 R
3,698,140 10/1972 Steadman ..... 51/241 G

FOREIGN PATENT DOCUMENTS 0161090 11/1985 European Pat. Off. .

*Primary Examiner*—Bruce M. Kisliuk
*Assistant Examiner*—Bryan Reichenbach
*Attorney, Agent, or Firm*—Jacobson, Price, Holman & Stern

[57] ABSTRACT

A hand-held grinding device 1, 50, 60 for sharpening the cutting edge 3 of a chisel 4 comprises a housing 5 in which a grinding wheel 6 is mounted and a handle member 7 defining a guide channel 20 for directing the cutting edge 3 to the wheel 6. The grinding wheel 6 is mounted on a shaft 10 with a free end 8 for mounting in the chuck 9 of a power tool 19. The guide channel 20 has a rear end entry 22 and an end exit 21 adjacent to the grinding surface of the wheel 6. The cutting edge 3 of a chisel 4 to be sharpened is urged against the grinding wheel 6 by spring biassing elements 25, 26 extending into the guide channel 20. A forward bridge 30 is provided above the exit 21 and a rearward bridge member 35 is provided above the end entry 22.

15 Claims, 5 Drawing Sheets

GRINDING DEVICE

Figure 1:
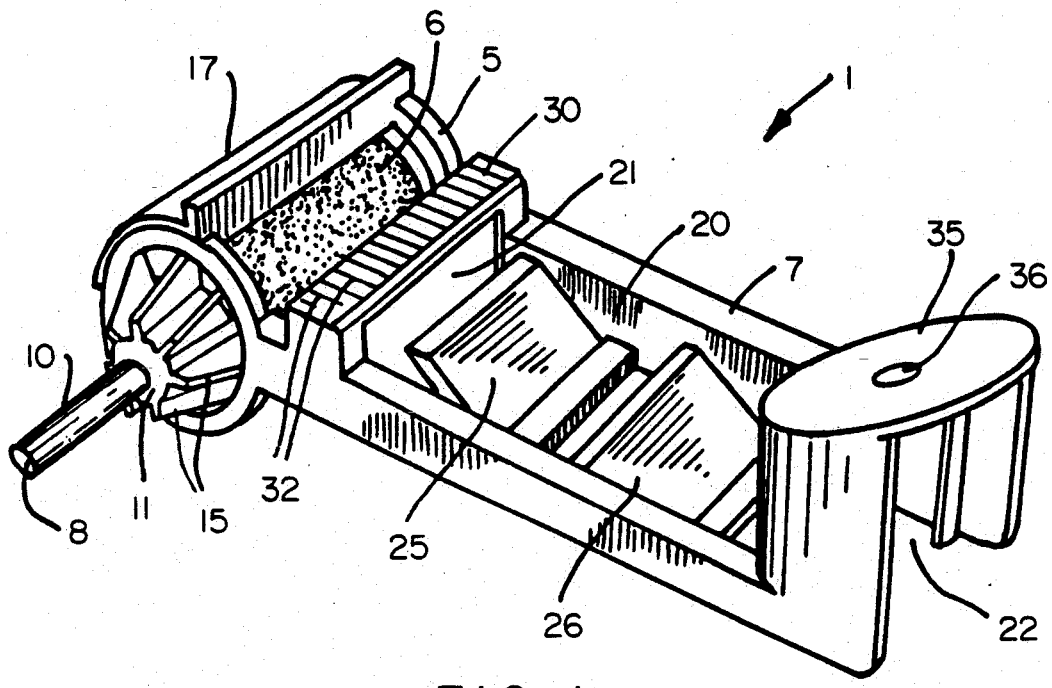

The invention relates to a grinding device for sharpening a cutting edge of a tool such as a chisel or the like. The term "chisel" as used in this specification includes tools similar to chisels.

According to the invention there is provided a hand-held device for sharpening a cutting edge of a tool such as a chisel or the like, the device comprising:

a housing, a grinding wheel rotatable in the housing about an axis of rotation, the grinding wheel having a grinding surface, and a handle member extending from the housing, the handle member having chisel guide means to direct the cutting edge of a chisel to be sharpened to the grinding surface of the grinding wheel.

In one embodiment of the invention the chisel guide means and grinding wheel are arranged so that, on sharpening, a bevelled cutting edge is produced on the chisel.

In one embodiment of the invention the chisel guide means and grinding wheel are arranged so that the cutting edge of the chisel extends, during sharpening, along a peripheral grinding surface of the grinding wheel.

Preferably the chisel guide means and grinding wheel are arranged so that the cutting edge of the chisel extends, during sharpening, substantially parallel to the axis of rotation of the grinding wheel.

In one embodiment of the invention the handle includes biassing means against which a user presses a chisel to engage a cutting edge of a chisel against the grinding surface.

In one embodiment of the invention the biassing means comprises spring biassing means.

The spring biassing means may, for example, comprise at least one spring element extending into the guide means against which a chisel is pressed by a user to engage a cutting edge of a chisel against the grinding surface.

In one embodiment of the invention there are at least two spring elements which are longitudinally spaced-apart in the guide means.

In a preferred embodiment of the invention the guide means comprises a guide channel having an end exit adjacent the grinding surface of the grinding wheel and a rear end entry through which a chisel is inserted into the guide channel, for sharpening.

In one embodiment of the invention a forward bridge member is provided above the end exit of the guide channel to prevent a user accessing the region of the device where a cutting edge of a chisel engages the grinding surface.

In another embodiment of the invention a rearward bridge member is provided above the end entry for guiding a chisel to be sharpened into the guide channel.

In a preferred embodiment of the invention the rearward bridge member is inclined upwardly rearwardly to accommodate the handle of a chisel. The rearward bridge member may include a through hole for mounting the device.

In a preferred embodiment of the invention the grinding wheel is mounted on a shaft having a free end for attachment to a chuck, for example, the chuck of a power drill.

In one embodiment of the invention the housing and handle are an integral plastics body.

The housing for the grinding wheel may be hollow to provide passage of air for cooling.

In a preferred embodiment of the invention a protective cap is provided on the housing to enclose the grinding wheel other than the portion of the grinding surface which engages a cutting edge of a chisel.

Figure 2:
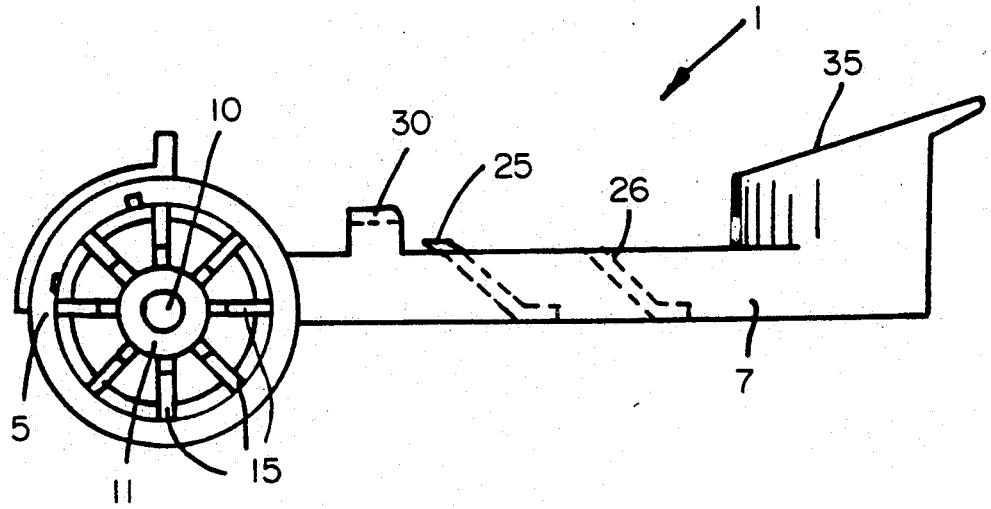
Figure 4:
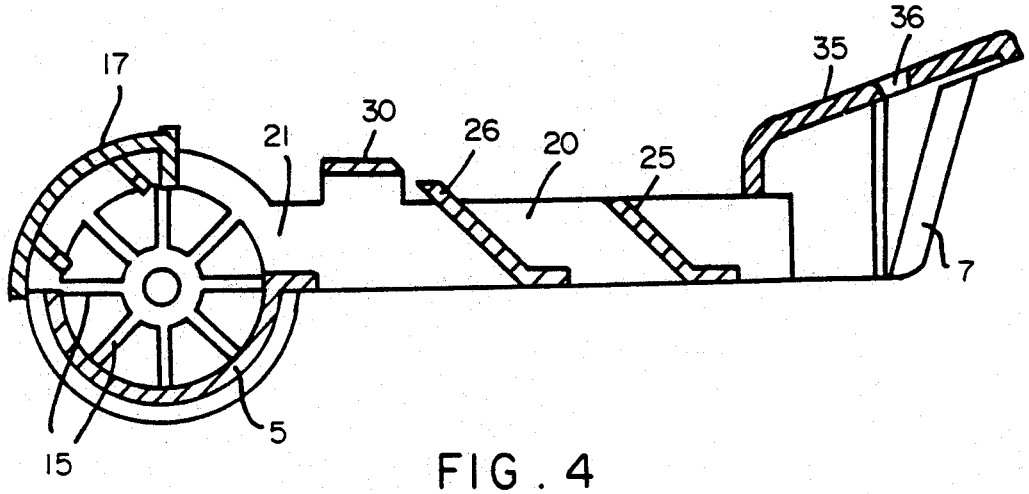
Figure 3:
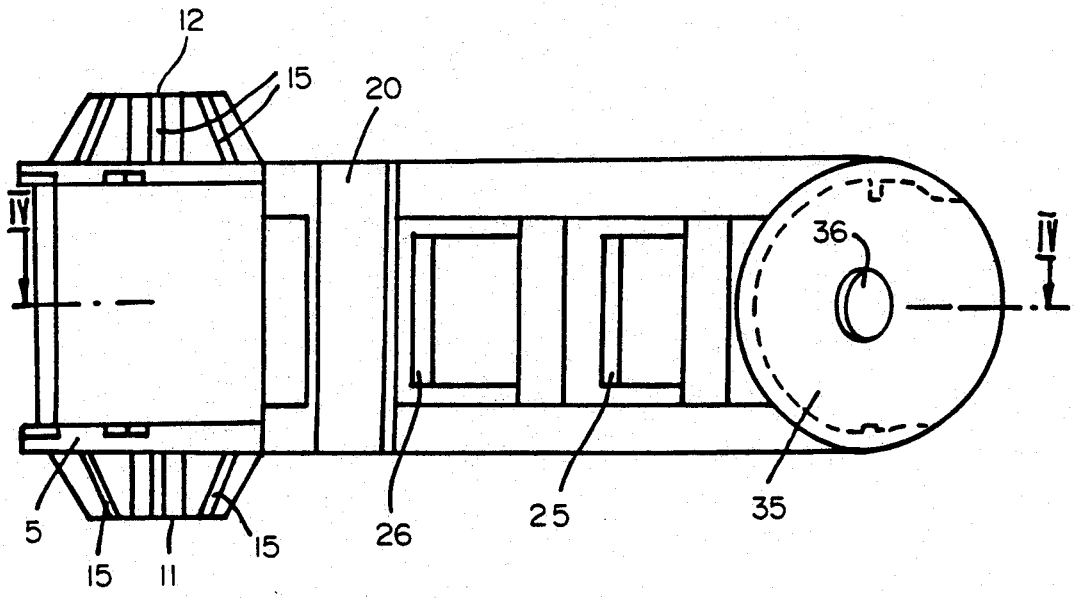
Figure 5:
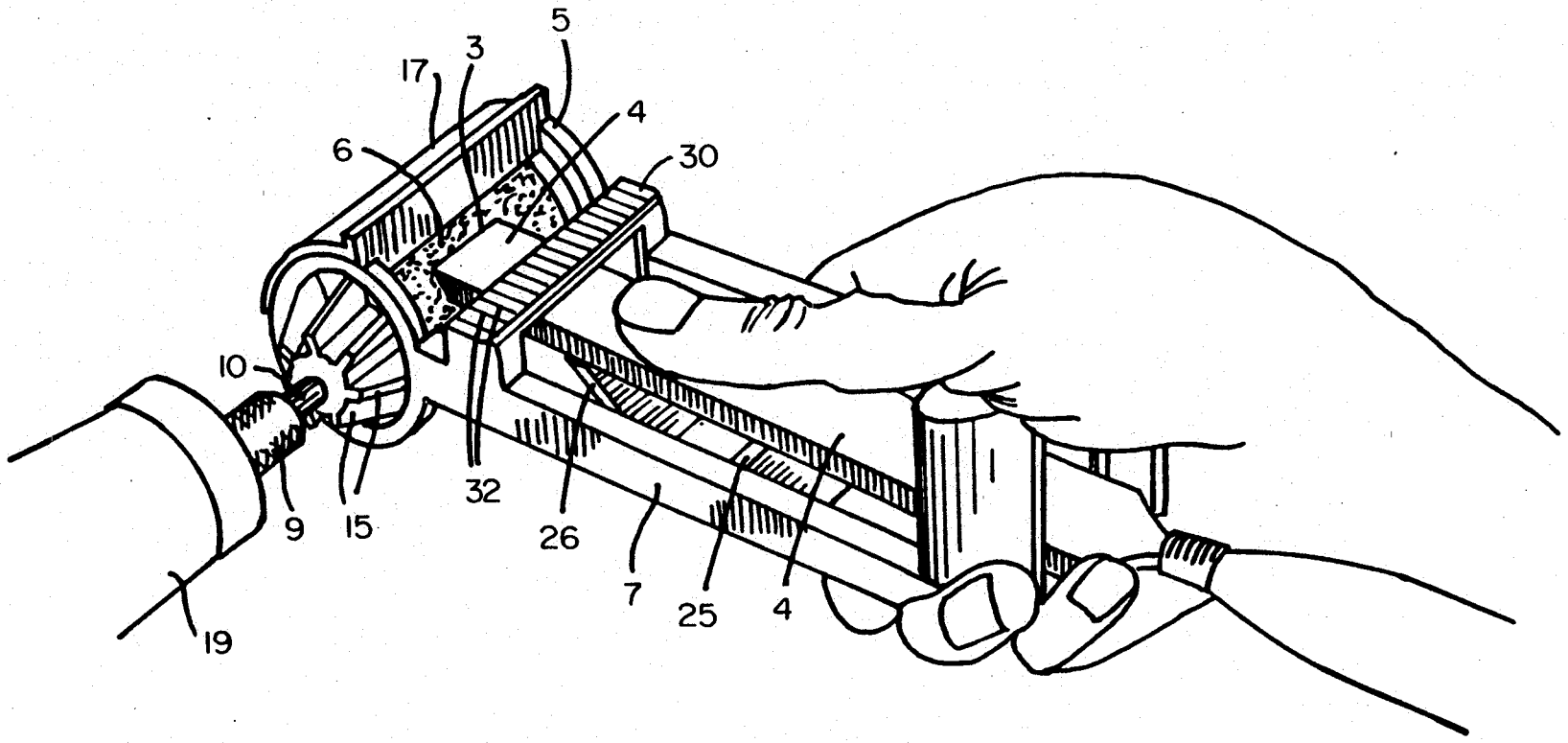
Figure 6:
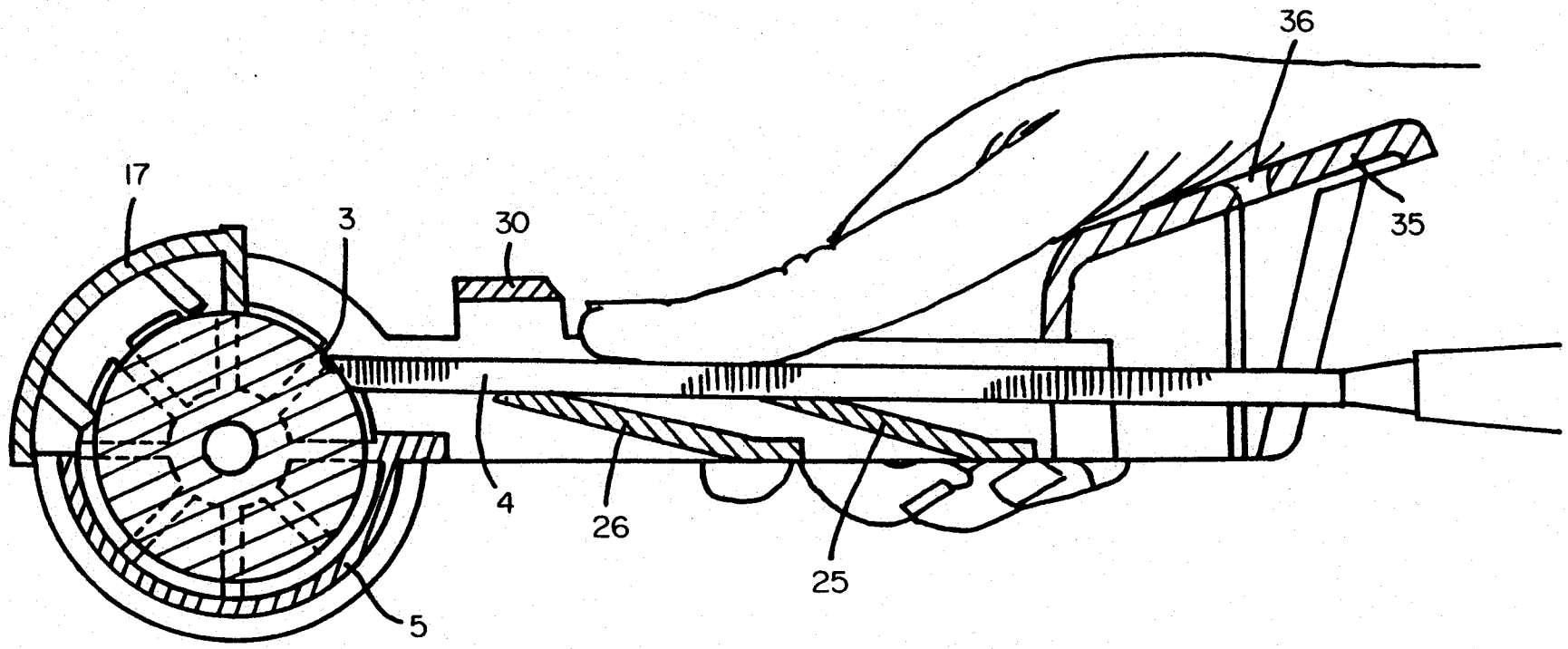
Figure 8:
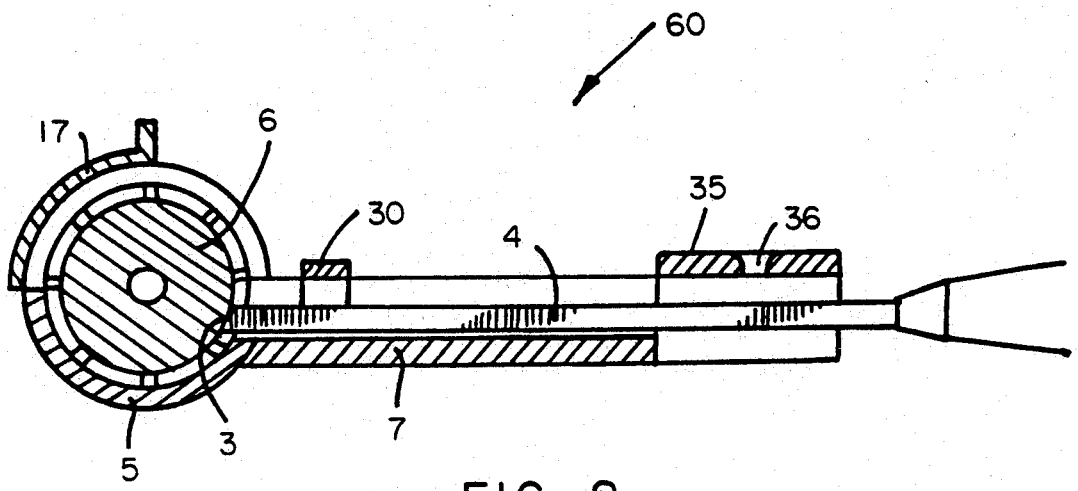
Figure 7:
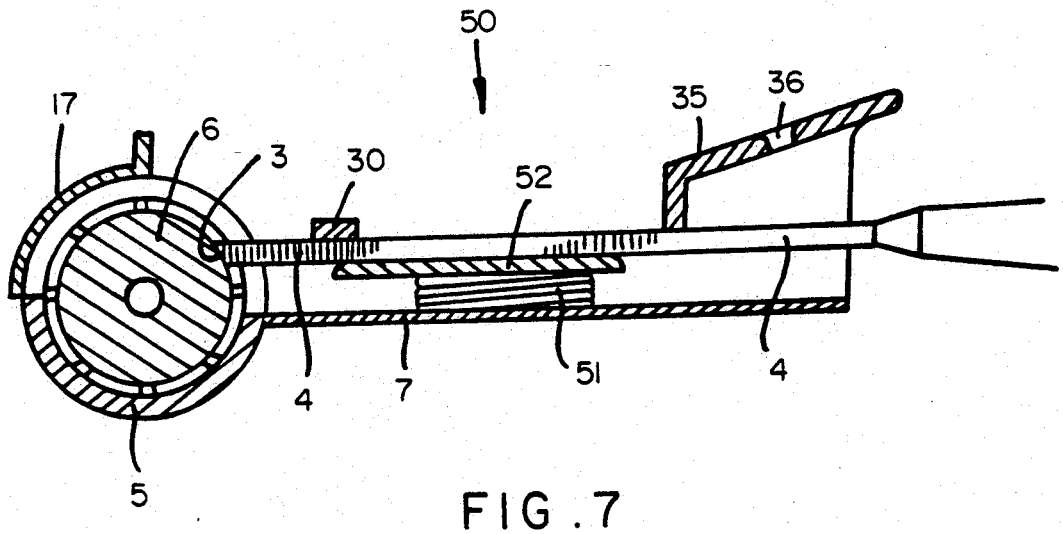

The invention will be more clearly understood from the following description thereof given by way of example only with reference to the accompanying drawings in which:

FIG. 1 is a perspective view of a chisel sharpening device according to the invention, FIG. 2 is a side view of the device, FIG. 3 is a plan view of the device with the grinding wheel removed, FIG. 4 is a cross-sectional view on the line IV—IV in FIG. 3, FIG. 5 is a perspective view of the device, in use, FIG. 6 is a side view of the device, in use, FIG. 7 is a cross-sectional view of an alternative construction of device, and FIG. 8 is a cross-sectional view of a further alternative construction of chisel sharpening device.

Referring to the drawings and initially to FIGS. 1 to 6 thereof there is illustrated a hand-held device according to the invention indicated generally by the reference numeral 1 for sharpening a cutting edge 3 of a tool such as a chisel 4 or the like.

The device 1 comprises a housing 5, a grinding wheel 6 rotatably mounted in the housing 5 about an axis of rotation and a handle member 7 extending from the housing 5.

The grinding wheel 6 is mounted on a shaft 10 having a free end 8 for attachment to a chuck 9, for example, the chuck 9 of a power drill 19 as illustrated in FIG. 5. The shaft 10 extends through bearings 11, 12 on opposed sides of the housing 5. The housing 5 is of hollow construction and fins 15 extend from the bearings 11, 12 to provide passage of air for cooling and to promote cooling efficiency.

A protective cap 17 is provided on the housing 5 and is of arcuate shape to enclose the grinding wheel 6 other than that portion of the grinding surface which engages the cutting edge 3 of the chisel 4. The cap 17 is typically a separately moulded plastics part which is fitted to the housing 5.

The handle member 7 is integrally moulded from a plastics material with the housing 5 and comprises a tool guide channel 20 having an end exit 21 adjacent the grinding surface of the grinding wheel 6 and a rear end entry 22 through which the chisel 4 is inserted into the guide channel 20 for sharpening.

Biassing means against which a user presses the chisel 4 to engage a cutting edge 3 of the chisel 4 against the grinding surface of the grinding wheel 6 in this cases comprises two longitudinally spaced-apart spring elements 25, 26 provided in the guide channel 20 and against which the chisel 4 is pressed by a user as illustrated in FIGS. 5 and 6 to engage the cutting edge 3 of the chisel 4 against the grinding surface of the grinding wheel 6.

A forward safety bridge member 30 is provided above the end exit 21 of the guide channel 20 to prevent a user accessing the region of the device where the cutting edge 3 of the chisel 4 engages the grinding surface of the grinding wheel 6. The forward bridge 30 also combines with the spring elements 25, 26 to positively position the cutting edge 3 of the chisel 4 for aligning the cutting edge 3 to the grinding stone 6 prior to grinding and during grinding. It will be noted that the forward bridge member 30 has a plurality of spaced-apart line markings or ridges 32 to assist the user in aligning the chisel 4 with the grinding wheel 6.

A rearward bridge member 35 which is of substantially disc-shape is provided above the end entry 22 for guiding the chisel 4 to be sharpened into the guide channel 20. It will be noted that the rearward bridge member 35 is inclined upwardly and rearwardly with respect to a longitudinal axis of the tool guide channel 20, as will be particularly apparent from FIGS. 2 and 4, to accommodate a handle of a chisel, particularly a short shanked chisel. The bridge member 35 includes a through hole 36 which may be used for mounting the device for storage.

As will be particularly apparent from FIG. 6 the arrangement of the housing 5 and guide channel 20 is such as to ensure that, on grinding, a bevelled edge is produced at the cutting edge 3 of the chisel 4. Because a bevel is produced there is no burr and the resulting sharpening is extremely good. Further, the action of the chisel 4 in use is greatly improved as the bevelled edge promotes the removal of material by the chisel 4 and a generally smooth operation of the chisel 4 in use.

It will be appreciated that because the housing 5 and guide 7 are an integral plastics body vibration is minimized. Because the device is hand-held it is easy to use as will be further described below.

In use, a chisel 4 to be sharpened is led through the end entry 22, is pushed downwardly against the spring elements 25, 26 underneath the bridge 30 until the cutting edge 3 of the chisel 4 is offered up to the grinding surface of the grinding wheel 6. The power drill 19 is then operated to drive the chuck 9 and hence drive the grinding wheel 6. The user then grips the device as illustrated in FIGS. 5 and 6 and pushes downwardly with his thumb on the blade of the chisel 4 until the cutting edge 3 engages against the grinding surface of the grinding wheel 6 as illustrated in FIGS. 5 and 6.

The user maintains pressure against the biassing of the spring elements 25, 26 until the cutting edge 3 is sharpened and a bevelled edge is formed. The pressure on the blade of the chisel 4 is then released and the chisel 4 travels upwardly under the biassing of the spring elements 25, 26 against the underside of the bridge 30. The power drill 19 is then stopped, preventing further rotation of the grinding wheel 6. When the grinding wheel 6 has stopped rotating, the chisel 4 is withdrawn through the end entry 22.

The device according to the invention may accommodate a wide range of chisel types and sizes. Various guides and/or stop arrangements may be used, if necessary, to align various chisel sizes in use.

Referring to FIG. 7 there is illustrated an alternative construction of hand-held device according to the invention and indicated generally by the reference numeral 50. The device 50 is of similar construction to the device 1 described above with reference to FIGS. 1 to 6 and like parts are assigned the same reference numerals. In this case the spring biassing means comprises a coil type spring 51 which urges a plate member 52 into engagement with the blade of the chisel 4.

Referring to FIG. 8 there is illustrated an alternative construction of device 60 which again is similar to the device described above with reference to FIGS. 1 to 6 and like parts are assigned the same reference numerals. In this case the arrangement is reversed and the chisel 4 is introduced underneath the grinding wheel 6.

The invention is not limited to the embodiments hereinbefore described which may be varied in both construction and detail.

I claim:

1. A hand-held grinding device for sharpening a cutting edge of a tool such as a chisel, the device comprising:

a housing;

a shaft rotatably mounted in the housing for rotation about an axis of rotation, the shaft having a free end for attachment to a chuck for rotation of the shaft;

a grinding wheel mounted on the shaft, the grinding wheel having a grinding surface;

an elongate handle member extending from the housing, the elongate handle member defining a tool guide channel adapted to direct a cutting edge of the tool to be sharpened to the grinding surface of the grinding wheel, and the tool guide channel having an end exit adjacent to the grinding surface of the grinding wheel and a rear end entry through which the tool is inserted into the tool guide channel for sharpening; and biassing means on the elongate handle member extending into the tool guide channel and against which a user presses the tool to engage the cutting edge of the tool against the grinding surface of the grinding wheel.

2. A grinding device as claimed in claim 1 wherein the tool guide channel and grinding wheel are arranged so that, on sharpening, a bevelled cutting edge is produced on the tool.

3. A grinding device as claimed in claim 1 wherein the tool guide channel and grinding wheel are arranged so that the cutting edge of the tool extends, during sharpening, along a peripheral grinding surface of the grinding wheel.

4. A grinding device as claimed in claim 1 wherein the tool guide channel and grinding wheel are arranged so that the cutting edge of the tool extends, during sharpening, substantially parallel to the axis of rotation of the grinding wheel.

5. A guiding device as claimed in claim 1 wherein the biassing means comprises spring biassing means.

6. A grinding device as claimed in claim 5 wherein the spring biasing means comprises at least one spring element extending into the tool guide channel and against which the tool is pressed by the user to engage the cutting edge of the tool against the grinding surface of the grinding wheel.

7. A grinding device as claimed in claim 6 wherein the spring biassing means comprises at least two spring elements which are longitudinally spaced-apart in the tool guide channel.

8. A grinding device as claimed in claim 1 wherein a forward bridge member is provided above the end exit of the tool guide channel to prevent the user accessing the region of the device where the cutting edge of the tool engages the grinding surface.

9. A grinding device as claimed in claim 1 wherein a rearward bridge member is provided above the end entry of the tool guide channel for guiding the tool to be sharpened into the tool guide channel.

10. A grinding device as claimed in claim 9 wherein the rearward bridge member is inclined upwardly and rearwardly with respect to a longitudinal axis of the tool guide channel to accommodate a handle of the tool.

11. A grinding device as claimed in claim 10 wherein the rearward bridge member includes a through hole for mounting the device.

12. A grinding device as claimed in claim 1 wherein the chuck is the chuck of a power drill.

13. A grinding device as claimed in claim 1 wherein the housing and handle are an integral plastic body.

14. A grinding device as claimed in claim 11 wherein the housing for the grinding wheel is hollow to provide passage of air for cooling.

15. A grinding device as claimed in claim 1 wherein a protective cap is provided on the housing to enclose the grinding wheel other than the portion of the grinding surface which engages the cutting edge of the tool.

* * * * *